US012680419B2

(12) United States Patent
Gonzalez et al.

(10) Patent No.: US 12,680,419 B2
(45) Date of Patent: Jul. 14, 2026

(54) HIGH FLOW, TUBING INSENSITIVE, DEEP SET WIRELINE RETRIEVABLE SAFETY VALVE

(71) Applicant: Halliburton Energy Services, Inc., Houston, TX (US)

(72) Inventors: Merced Gonzalez, Singapore (SG); Matthew Gassen, Carrollton, TX (US); James Williams, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/011,107

(22) Filed: Jan. 6, 2025

(65) Prior Publication Data

US 2026/0193957 A1 Jul. 9, 2026

(51) Int. Cl.
*E21B 34/08* (2006.01)
*E21B 34/10* (2006.01)
*E21B 34/16* (2006.01)

(52) U.S. Cl.
CPC ..... *E21B 34/08* (2013.01); *E21B 34/106* (2013.01); *E21B 34/16* (2013.01)

(58) Field of Classification Search
CPC ..... E21B 34/105; E21B 34/106; E21B 34/107
See application file for complete search history.

(56) References Cited

U.S. PATENT DOCUMENTS 3,763,932 A 10/1973 Dinning
3,763,933 A 10/1973 Mott
3,860,066 A * 1/1975 Pearce ..... E21B 34/101 166/72
4,273,186 A 6/1981 Pearce et al.
(Continued)

FOREIGN PATENT DOCUMENTS

EP 1138873 8/2005
GB 2378970 2/2003
(Continued)

OTHER PUBLICATIONS

"PCT Application No. PCT/US2024/022952 International Search Report and Written Opinion", 12 pages.
(Continued)

*Primary Examiner* — Giovanna Wright
(74) *Attorney, Agent, or Firm* — DeLizio, Peacock, Lewin & Guerra LLP

(57) ABSTRACT

Embodiments of a high flow, tubing insensitive, deep set wireline retrievable safety valve are disclosed herein. In one embodiment, a valve system for use downhole in a wellbore comprises a tubing retrievable safety valve (TRSV) and a secondary safety valve to be positioned within the TRSV. The secondary safety valve comprises at least a valve body having a valve seat at a downhole end; a piston; a rod coupled with the piston; a control line; a first pressure communication port, communicatively coupling the control line of safety valve with the TRSV control line; a balance line; and a second pressure communication port, communicatively coupling the balance line of the safety valve with the TRSV balance line; wherein the control line is configured to actuate the safety valve between an open position and a closed position in response to an intentional pressure change in the control line.

20 Claims, 7 Drawing Sheets

(56) References Cited

U.S. PATENT DOCUMENTS

| | | | | |
|---|---|---|---|---|
| 4,440,221 | A | 4/1984 | Taylor et al. | |
| 4,577,694 | A | 3/1986 | Brakhage, Jr. | |
| 4,605,070 | A | 8/1986 | Morris | |
| 4,621,695 | A | 11/1986 | Pringle | |
| 5,496,044 | A | 3/1996 | Beall et al. | |
| 5,598,864 | A * | 2/1997 | Johnston | E21B 34/102 137/68.16 |
| 6,003,605 | A | 12/1999 | Dickson et al. | |
| 6,352,118 | B1 | 3/2002 | Dickson et al. | |
| 7,032,672 | B2 | 4/2006 | Dennistoun et al. | |
| 7,392,849 | B2 | 7/2008 | Lauderdale et al. | |
| 7,552,774 | B2 | 6/2009 | Anderson et al. | |
| 7,694,742 | B2 | 4/2010 | Bane | |
| 8,251,147 | B2 | 8/2012 | Mondelli et al. | |
| 9,206,670 | B2 | 12/2015 | Webber et al. | |
| 9,383,029 | B2 | 7/2016 | Scott | |
| 9,523,260 | B2 | 12/2016 | Mailand et al. | |
| 9,739,116 | B2 | 8/2017 | Kirkpatrick | |
| 9,982,510 | B2 | 5/2018 | Vick, Jr. et al. | |
| 10,030,475 | B2 | 7/2018 | Vick, Jr. | |
| 10,113,392 | B2 | 10/2018 | Vick, Jr. et al. | |
| 10,513,908 | B2 | 12/2019 | Scott et al. | |
| 10,655,431 | B2 | 5/2020 | Gonzalez et al. | |
| 10,920,529 | B2 | 2/2021 | Mailand et al. | |
| 10,989,020 | B2 | 4/2021 | Vick, Jr. | |
| 11,015,418 | B2 | 5/2021 | Burris et al. | |
| 11,131,161 | B2 | 9/2021 | Fripp et al. | |
| 11,180,974 | B2 | 11/2021 | Vick, Jr. et al. | |
| 11,661,826 | B2 | 5/2023 | Dusterhoft et al. | |
| 2002/0074129 | A1 | 6/2002 | Moore | |
| 2005/0056414 | A1 | 3/2005 | Dennistoun et al. | |
| 2005/0056430 | A1 | 3/2005 | Dennistoun et al. | |
| 2006/0196669 | A1 | 9/2006 | Lauderdale et al. | |
| 2008/0066921 | A1 | 3/2008 | Bane et al. | |
| 2008/0128137 | A1 | 6/2008 | Anderson et al. | |
| 2009/0090501 | A1 | 4/2009 | Hansen et al. | |
| 2009/0277643 | A1 | 11/2009 | Mondelli et al. | |
| 2011/0094752 | A1 | 4/2011 | Hudson et al. | |
| 2013/0032355 | A1 | 2/2013 | Scott et al. | |
| 2013/0220624 | A1 | 8/2013 | Hill et al. | |
| 2014/0000870 | A1 | 1/2014 | Vick, Jr. | |
| 2015/0316170 | A1 | 11/2015 | Scott | |
| 2015/0354316 | A1 | 12/2015 | Kirkpatrick | |
| 2015/0361763 | A1 | 12/2015 | Mailand et al. | |
| 2015/0369005 | A1 | 12/2015 | Vick, Jr. | |
| 2016/0258250 | A1 | 9/2016 | Vick, Jr. | |
| 2017/0067315 | A1 | 3/2017 | Mailand et al. | |
| 2018/0202261 | A1 | 7/2018 | Scott et al. | |
| 2018/0328145 | A1 | 11/2018 | Gonzalez et al. | |
| 2018/0355698 | A1 | 12/2018 | Williamson et al. | |
| 2019/0353008 | A1 | 11/2019 | Lake | |
| 2019/0376366 | A1 | 12/2019 | Burris et al. | |
| 2020/0063518 | A1 | 2/2020 | Fripp et al. | |
| 2020/0240236 | A1 | 7/2020 | Cress et al. | |
| 2020/0308932 | A1 | 10/2020 | Vick, Jr. | |
| 2022/0065073 | A1 * | 3/2022 | Krupski | E21B 34/063 |
| 2023/0037547 | A1 | 2/2023 | Newton | |
| 2024/0125205 | A1 | 4/2024 | Gonzalez | |
| 2024/0337170 | A1 | 10/2024 | Gassen et al. | |

FOREIGN PATENT DOCUMENTS

| | | |
|---|---|---|
| NO | 781238 | 10/1978 |
| WO | 2018227003 | 12/2018 |
| WO | 2022154944 | 7/2022 |

OTHER PUBLICATIONS

"U.S. Appl. No. 18/610,964 Non-Final Office Action", Mar. 14, 2025, 23 pages.

"PCT Application No. PCT/US2023/086481 International Search Report and Written Opinion", Apr. 26, 2024, 8 pages.

"U.S. Appl. No. 18/535,644 Non Final Office Action", Sep. 20, 2024, 9 pages.

Schlumberger, "GeoGuard high-performance deepwater safety valves", 2021, 1 page.

"PCT Application No. PCT/US2025/013903 International Search Report and Written Opinion", Sep. 26, 2025, 13 pages.

* cited by examiner

HIGH FLOW, TUBING INSENSITIVE, DEEP SET WIRELINE RETRIEVABLE SAFETY VALVE

FIELD

This disclosure relates generally to safety valves used with completion tools in a wellbore. More particularly, this disclosure relates to a safety valve that is tubing insensitive, and specifically the pressure in the tubing, for use in downhole operations, such as hydrocarbon production, as a secondary safety valve.

BACKGROUND

Well safety valves may be installed in a wellbore to prevent uncontrolled release of reservoir fluids. For example, safety valves may be configured to close if there is a failure or other emergency situation in the system that could lead to uncontrolled release of reservoir fluids. In embodiments, a subsurface safety valve may be biased to a closed position, so that it is configured to close the valve in the event that operator control is lost. A safety valve should ideally close as quickly and/or reliably as possible during a process upset or in the event of an emergency, to ensure operational and/or environmental safety. While there are different types of safety valves, hydraulic safety valves may be configured to automatically close in the event of loss of pressure. For example, hydraulic safety valves may be opened by application of hydraulic pressure to a piston, which can actuate the valve to position it in an open position. The hydraulic control pressure holds the valve in the open position. If control pressure is lost, the valve would then close.

One type of hydraulic safety valve is a tubing retrievable safety valve. A tubing retrievable safety valve (TRSV) may be adapted to be positioned in a well tubing string (e.g. a tubular string, such as production tubing), to control the flow through the tubing string. As TRSVs are often subjected to years of service in severe operating conditions, failure of the TRSV is possible. For example, a TRSV in the closed position may eventually form leak paths. Alternatively, a TRSV in the closed position may not properly open when actuated. Because of the potential for operational problems in the absence of a properly functioning TRSV (and especially since TRSVs often function as failsafe valves, having important safety implications), mitigation measure must be taken promptly when there is a TRSV failure. Since TRSVs are incorporated into the production tubing, however, repairing or replacing a malfunctioning TRSV would require removal of the entire production tubing, which can be expensive and/or time-consuming. Thus, there is a need for an effective way to mitigate TRSV failure, for example so that safety valve operation can be restored without having to remove the production tubing from the well. This can be particularly challenging in deep set applications, for example due to issues arising from hydrostatic pressure.

BRIEF DESCRIPTION OF THE DRAWINGS

Embodiments of the disclosure may be better understood by referencing the accompanying drawings.

DETAILED DESCRIPTION

Figure 1:
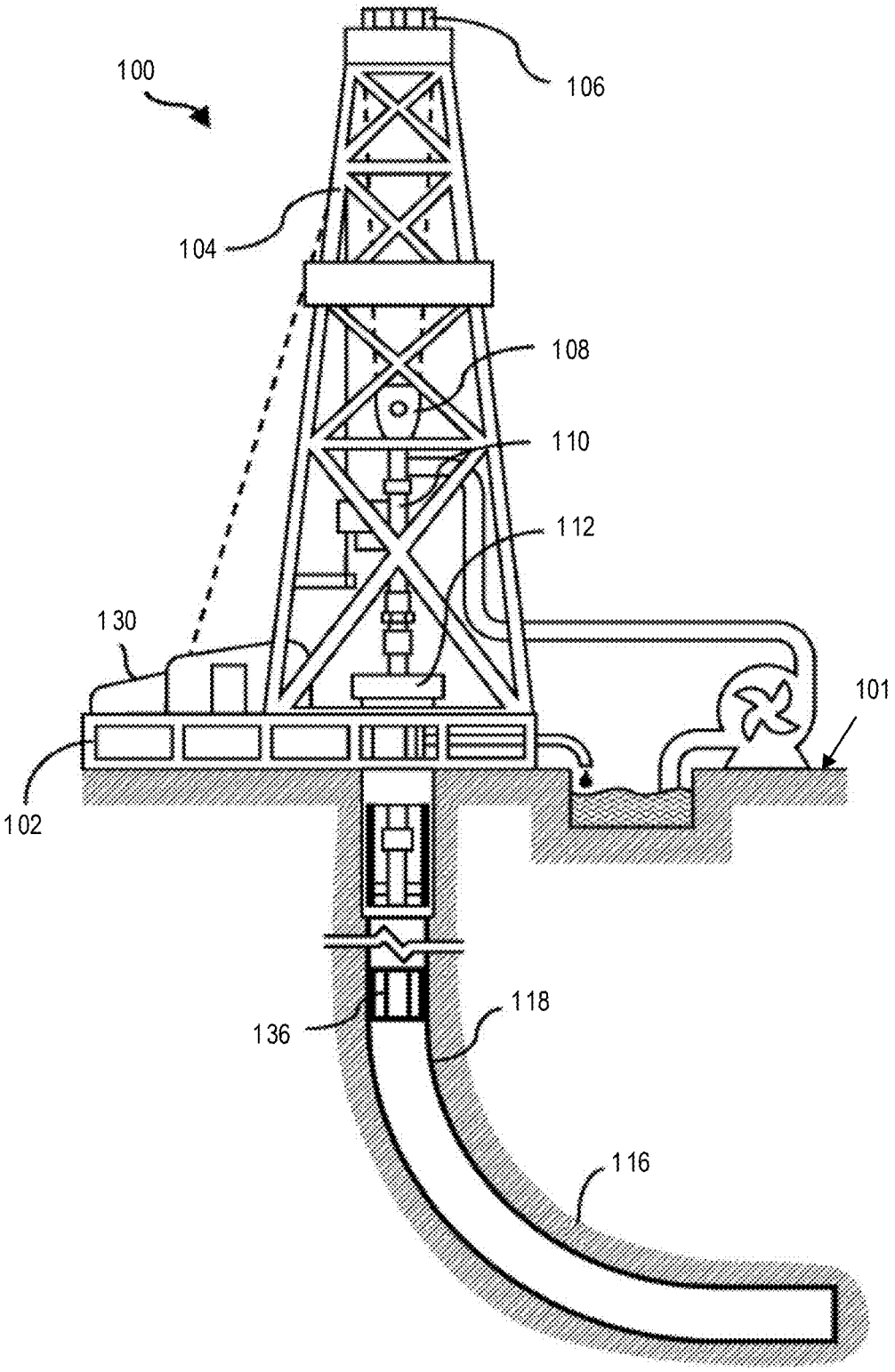
FIG. 1 is a diagram of an example drilling environment having an illustrative safety valve, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Referring now to the drawings, wherein like reference numbers are used herein to designate like elements throughout the various views, various embodiments are illustrated and described. The figures are not necessarily drawn to scale; and in some instances, the drawings have been exaggerated and/or simplified in places for illustrative purposes only. In the following description, the terms "upper," "upward," "lower," "below," "downhole" and the like, as used herein, shall mean: in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

Hydrocarbons, such as oil and gas, are commonly obtained from subterranean formations that may be located onshore or offshore. The development of subterranean operations and the processes involved in removing hydrocarbons from a subterranean formation may be complex. Typically, subterranean operations in a wellbore involve a number of different steps such as, for example, drilling a wellbore, at a desired well site, treating the wellbore to optimize production of hydrocarbons, and performing the necessary steps to produce and process the hydrocarbons from the subterranean formation.

When a TRSV fails to operate, a secondary safety valve or insert valve, such as a Wireline Retrievable Safety Valve (WLRSV) may be employed to shut in a well as required. A deep set application brings along challenges to the wireline safety valve as most are tubing pressure sensitive and are limited in setting depth. The deeper the setting in the wellbore, the more hydrostatic pressure is experienced by the safety valve. Traditional methods include nitrogen-charged chambers or long power springs to compensate for the higher hydrostatic control line pressure. These solutions are not preferred due to the high cost and lower reliability. Current insert valves have limited flow and have high pressure drops. Existing designs include complex control systems through body connections and seals, increasing the risk of failure due to leaks.

Embodiments of an improved safety valve are disclosed herein. A secondary safety valve may be used in deep set conditions which provide for a wider range of depths of a wellbore where the safety valve may be used. The secondary safety valve is a deep set secondary safety valve, which may be a WLRSV, disclosed herein is a tubing insensitive, flapper-less safety valve, insensitive to pressure in the tubing, with a capability of increased flow production compared to typical flapper or ball valves. The secondary safety valve requires two separate pressure communication ports from TRSV to the secondary safety valve. The first communication port provides communication from the TRSV control line to the secondary safety valve's control line. The second communication port provides communication from the TRSV balance line to the balance line of the secondary safety valve. The balance line communication will allow a balance of hydrostatic pressure so that the power spring does not have to overcome the hydrostatic pressure of the control line fluid to close the valve.

The secondary safety valve includes centralized control piston design which significantly increases the flow area and decreases pressure drop to reduce turbulent flow. The control piston may be located uphole of the closure mechanism and as such simplifies the hydraulic actuation port system limiting leak potential. The shape of the closure mechanism optimizes flow through the seat greater than the current flapper or ball type closure mechanism designs. In some examples, the valve body includes a plurality of openings or windows in a portion of the valve body to enable increased flow production.

Solutions provided by the embodiments disclosed herein provide a secondary safety valve that are insensitive to pressure in the tubing and not depth limited. The disclosed secondary safety valve provides increased production flow compared to traditional or previous examples of secondary safety valves (previous embodiments of WLRSV) and is tubing insensitive. Embodiments disclosed herein also provide a single centralized control piston to increase flow in the internal diameter of similar or same size valves. The embodiments disclosed also reduced the pressure drop from friction flowing through the valve. The parts/features in the valve are shaped to reduce turbulent flow, reducing the pressure drop from friction when flowing through the valve. For example, an angle of about 250 degrees may optimize flow around the valve. Embodiments of the improved secondary or inset safety valve also provides improvements over previous inset valves and WLSRV in that the disclosed safety valve is tubing insensitive, and specifically to the pressure in the tubing, and the proposed safety valve is connected with and uses both the control and balances lines of the TRSV. In addition, long springs are not required to compensate for hydrostatic pressure. The solution disclosed secondary safety valve and safety valve system and method may be used as a customer solution to replace less reliable TRSVs.

In one embodiment, a secondary safety valve for use in a tubing retrievable safety valve (TRSV) disposed downhole in a wellbore comprises a valve body having a valve seat; a centralized control piston positioned at a downhole end of the valve seat. A rod may be coupled with a downhole end of the piston, as well as exposed to the uphole end, such that the rod enables the safety valve to be pressure insensitive. Traditional rods have only been exposed at the uphole end, so they were not balanced in the tubing pressure. The safety valve includes a control line and a first pressure communication port, communicatively coupling the control line of safety valve with a control line of the TRSV. The safety valve also includes a balance line and a second pressure communication port, communicatively coupling the balance line of the safety valve with a balance line of the TRSV. The control line is configured to actuate the safety valve between an open position and a closed position in response to an intentional pressure change in the control line. In some embodiments, the safety valve is a wireline retrievable safety valve (WLRSV). In some examples, the intentional pressure change may be initiated by a signal communicated from the surface to release the control line pressure.

In another embodiment, a safety valve system for use downhole in a wellbore may include a TRSV disposed downhole in the wellbore, the TRSV including at least a balance line and a control line. A secondary safety valve may be positioned within the TRSV, the secondary safety valve, in some examples may be a WLRSV and may comprise at least a valve body having a valve seat, a centralized control piston, and a rod coupled with a downhole end of the piston. The safety valve further includes a control line and a first pressure communication port, communicatively coupling the control line of safety valve with the control line of the TRSV; and a balance line; and a second pressure communication port, communicatively coupling the balance line of the safety valve with the balance line of the TRSV. The control line is configured to actuate the safety valve between an open position and a closed position in response to an intentional pressure change in the control line.

Example Embodiments

FIG. 1 is a diagram of an example drilling environment. Drilling environment 100 may include platform 102 at a surface 101 that supports derrick 104 having a traveling block 108 for raising and lowering top drive 110 and drill string. Top drive 110 supports and rotates drill string as it is lowered through wellhead 112. In turn, drill bit 124, located at the end of drillstring, may create wellbore 116. Each of these components is described below.

Platform 102 is a structure which may be used to support one or more other components of drilling environment 100. Platform 102 may be designed and constructed from suitable materials (e.g., concrete) which are able to withstand the forces applied by other components (e.g., the weight and counterforces experienced by derrick 104). In any embodiment, platform 102 may be constructed to provide a uniform surface for drilling operations in drilling environment 100.

Derrick 104 is a structure which may support, contain, and/or otherwise facilitate the operation of one or more pieces of the drilling equipment. Derrick 104 may provide support for crown block 106, traveling block 108, and/or any part connected to and/or including a drillstring. Crown block 106 may be one or more simple machine(s) which may be rigidly affixed to derrick 104 and include a set of pulleys (e.g., a "block"), threaded (e.g., "reeved") with a drilling line (e.g., a steel cable), to provide mechanical advantage. Crown block 106 may be disposed vertically above traveling block 108, where traveling block 108 is threaded with the same drilling line. Traveling block 108 may include one or more simple machine(s) which may be movably affixed to derrick 104 and include a set of pulleys, threaded with a drilling line, to provide mechanical advantage. Traveling block 108 may be mechanically coupled to drillstring (e.g., via top drive 110) and allow for drillstring (and/or any component thereof) to be lifted from (and out of) wellbore 116. Both crown block 106 and traveling block 108 may use a series of parallel pulleys (e.g., in a "block and tackle" arrangement) to achieve significant mechanical advantage, allowing for the drillstring to handle greater loads (compared to a configuration that uses non-parallel tension). Traveling block 108 may move vertically (e.g., up, down) within derrick 104 via the extension and retraction of the drilling line.

Top drive 110 is a machine which may be configured to rotate drillstring. Top drive 110 may be affixed to traveling block 108 and configured to move vertically within derrick 104 (e.g., along with traveling block 108). Rotation of drillstring (caused by top drive 110) may allow for drillstring to carve wellbore 116. Top drive 110 may use one or more motors and gearing mechanisms to cause rotations of drillstring. In any embodiment, a rotatory table (not shown) and a "Kelly" drive (not shown) may be used in addition to, or instead of, top drive 110.

Wellhead 112 may include one or more pipes, caps, and/or valves to provide pressure control for contents within wellbore 116 (e.g., when fluidly connected to a well (not shown)). During drilling, wellhead 112 may be equipped with a blowout preventer (not shown) to prevent the flow of higher-pressure fluids (in wellbore 116) from escaping to the surface in an uncontrolled manner. Wellhead 112 may be equipped with other ports and/or sensors to monitor pressures within wellbore 116 and/or otherwise facilitate drilling operations. Wellbore 116 may be formed by a drillstring (and one or more components thereof). Wellbore 116 may be partially or fully lined with casing 118. Casing 118 is concrete and/or metal lining that separates wellbore 116 from the surrounding ground. Casing 118 may be used to protect the surrounding ground from the contents of wellbore 116, and conversely, to protect wellbore 116 from the surrounding ground.

Control system 130 may be a computing system which may be operatively connected to a drillstring and/or other various components of the drilling environment. Control system 130 may utilize any suitable form of wired and/or wireless communication to send and/or receive data to and/or from other components of drilling environment 100. Control system 130 may receive a digital telemetry signal, demodulate the signal, display data (e.g., via a visual output device), and/or store the data. In any embodiment, control system 130 may send a signal (with data) to one or more components of drilling environment 100 (e.g., to control one or more tools). In any embodiment, control system 130 is a hardware computing device which may be utilized to perform various steps, methods, and techniques disclosed herein via execution of software or a set of instructions. Control system 130 may include one or more processor(s), cache, memory, storage, and/or one or more peripheral device(s). Any two or more of these components may be operatively connected via a system bus that provides a means for transferring data between those components.

A safety valve system 136 may be placed into wellbore 116. In some embodiments, the safety valve system 136 may include at least a first safety valve, which may be a TRSV. In other examples, a secondary safety valve, such as disclosed herein, may be positioned within the TRSV as a back-up for the TRSV, or may also be used for repair/remediation of the wellbore in the event the TRSV fails. The secondary safety valve may be a wireline retrievable safety valve (WLRSV). The safety valve system 136 may be set deep into the wellbore 116 and as such may be subject to pressure and environmental conditions well known in wellbore environments.

Figure 2:
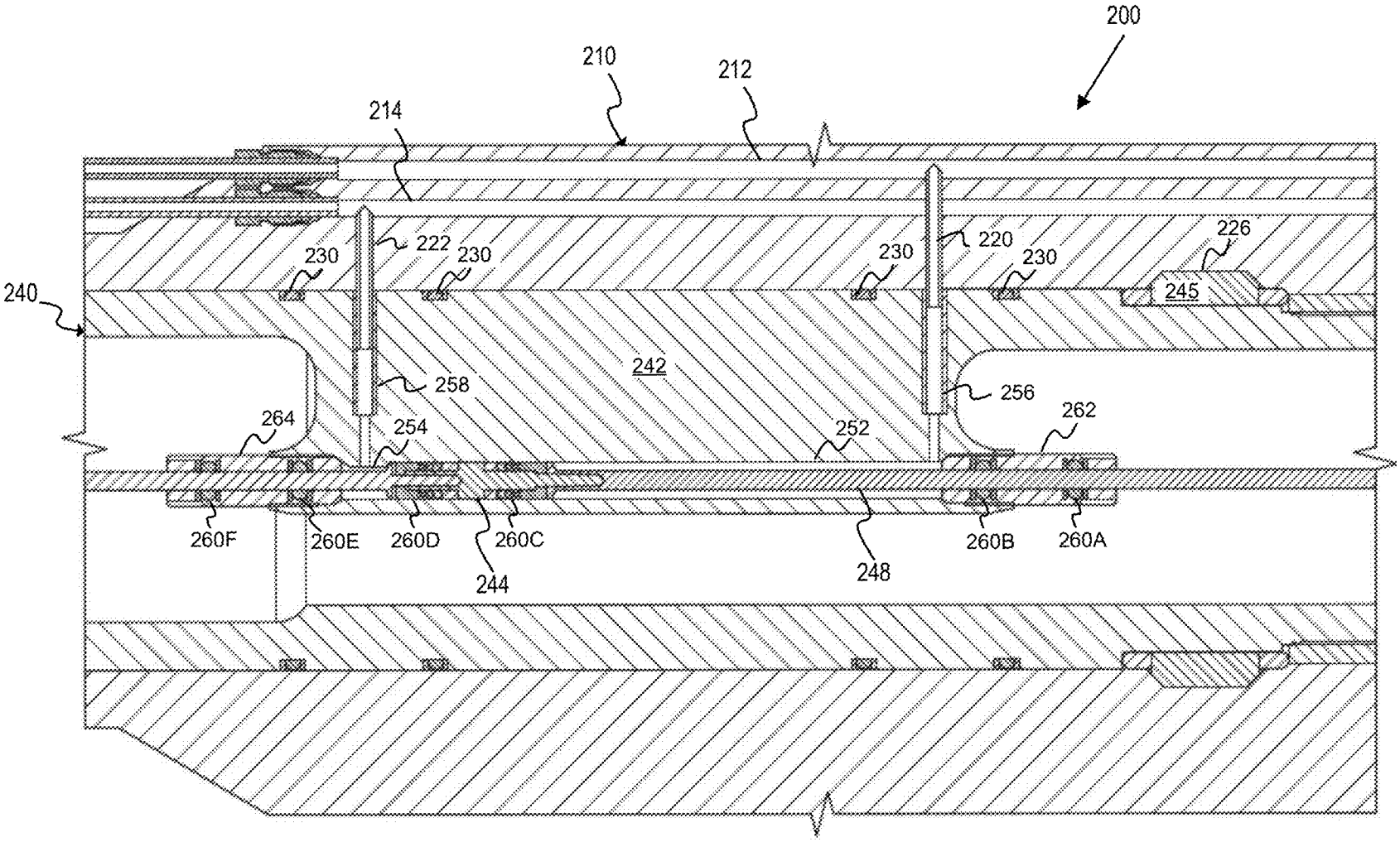
FIG. 2 is a side section view of one embodiment of an uphole end of a safety valve assembly, according to some embodiments.

Referring now to FIG. 2, there is shown side section view of a safety valve system 200. The safety valve system 200 may include a tubing retrievable safety valve (TRSV) 210 and a secondary safety valve 240 which may be used in deep set applications. The secondary safety valve 240, in some examples, may be a deep set wireline retrievable safety valve (WLRSV). The TRSV 210 may include a control line 214 and a balance line 212 which may be hydraulically connected with one or more components at the wellhead 112 and in some examples control system 130 hydraulic pressure may be applied to the control line 214 in order to open the TRSV. The balance line 212 can supply a balancing pressure to compensate for the effects of hydrostatic pressure on the control line 214. Control of the hydraulic pressure applied via the control line 214 and balance line 212 may be effectuated through, for example a control manifold, which may be located on the surface at the wellhead 112. The TRSV 210 includes an open bore therethrough to enable fluids to flow through the TRSV when in an open position. In the event of a failure of the TRSV 210, the secondary safety valve 240 may be installed therein. The secondary safety valve 240 may be run in hole in either a closed position or an open position. There is a locating profile 226 in an inner diameter of the TRSV 210. The secondary safety valve 240 has a locating key 245 on an outer diameter thereof. The secondary safety valve 240 is positioned into the wellbore within the open bore of the TRSV 210 and seated into the locating profile 226.

The secondary safety valve 240 includes a valve body 242, a centralized control piston 244, and a rod 248, the rod 248 positioned downhole of the piston 244 and configured to engage a closure mechanism, such as a poppet, at a downhole end of the secondary safety valve 240. The secondary safety valve 240 includes a control line 254 to actuate the secondary safety valve 240 between an open and closed position. The secondary safety valve 240 also includes a balance line 252 to provide a balanced hydrostatic pressure for the secondary safety valve 240. In order to fluidly communicate with the control line 214 and balance line 212 of the TRSV 210, prior to positioning the secondary safety valve 240 into the wellbore, a separate tool is run into the wellbore to install a control communication port 222 into the TRSV 210 to connect to and communicate with the control line 214 and a balance communication port 220 into the TRSV 210 to connect to and communicate with the balance line 212.

The secondary safety valve 240 includes a first pressure communication port 256 to fluidly connect the balance line 252 with the balance communication port 220 and balance line 212 of the TRSV 210 and a second pressure communication port 258 to fluidly connect the control line 254 with the control communication port 222 and control line 214 of the TRSV 210. Traditional communication methods, such as a shear plug (after shearing) or a communication tool, may also be used to accomplish the function of the balance and control communication ports 220 and 222. Once the balance line 252 and control line 254 of the secondary safety valve 240 are full of required fluid, the secondary safety valve 240 is ready for use. Both the control line 214 and balance line 212 of the TSRV need to be functional in order for the control line 254 and balance line 252 of secondary safety valve 240 to function to control the secondary safety valve 240.

Seals 230 are placed on both sides of each of the first and second pressure communication ports 256 and 258 to seal off the outer diameter of the secondary safety valve 240 from the TRSV 210 such that when the control line 214 of the TRSV 210 is pressured up, the pressure will communicate directly onto the control line 254—of the secondary safety valve. The secondary safety valve 240 further includes a plurality of seals 260A-260F. Seals 260A and 260B are positioned in a first seal housing 262 positioned downhole of the first pressure communication port 256, and seals 260E and 260F are positioned in a second seal housing 264 positioned uphole of the second pressure communication port 258. Seals 260A, 260B, 260E, and 260F may be o-rings, or other suitable seal components. The seals 260C and 260D may be o-rings or other suitable seals, or may be metal to metal seals created by the engagement of the piston 244 with the valve body 242. The seals 260A-260F isolate the various components of the secondary safety valve 240 from tubing pressure. The seals 260 also provide isolation while the first and second pressure communication ports 256 and 258 are being connected with the control line 214 and balance line 212 of the TRSV 210. The seals enable equal pressure throughout the secondary safety valve 240 such that there is no pressure differential across the secondary safety valve 240. Pressure to the control line 254 is only applied after an intentional pressure change is initiated. The secondary safety valve 240 is configured to move between an open configuration (shown in FIG. 3A-3B) and a closed configuration (shown in FIG. 4A-4C) upon an intentional pressure change in the control line 254. The intentional pressure change may be a signal to release the pressure in the control line 214 of the TSRV thereby releasing pressure in control line 254 to close the secondary safety valve 240, or if there is no pressure from the control communication port 222 of the TRSV 210, the control line 254 will lose pressure and the secondary safety valve 240 will close. The signal to release the pressure, in some examples, may come from the surface of the wellbore, such as from control system 130 shown in FIG. 1.

Figure 3A:
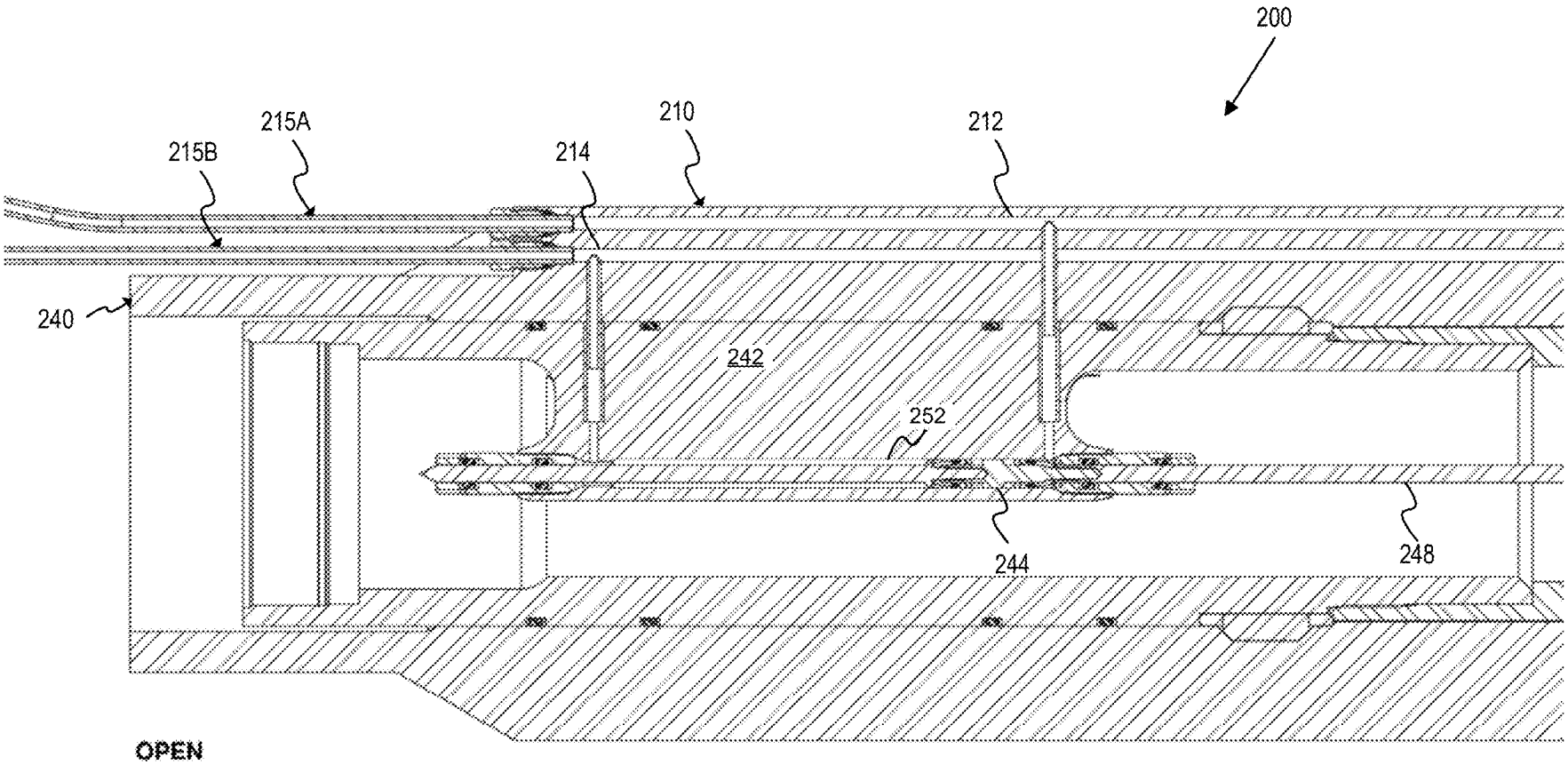
FIG. 3A is a side section view of an uphole end of the safety valve of FIG. 2 shown in an open position, according to some embodiments.
Figure 3B:
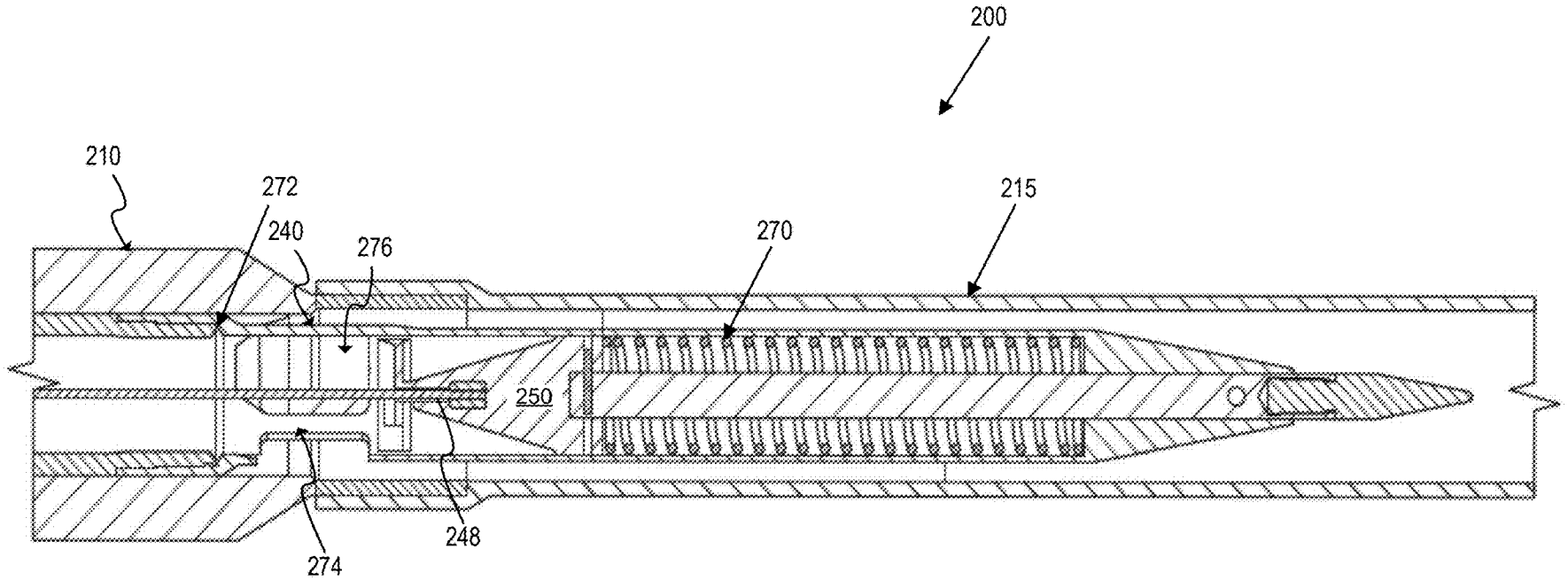
FIG. 3B is a side section view of a downhole end of the safety valve of FIG. 2 shown in an open position, according to some embodiments.

Referring now to FIG. 3A-3B, there is shown a side section view of the safety valve system 200 shown in an open position. In an open position, the control piston 244 and rod 248 are both shifted in a downhole direction and the control line 252 may be open and pressured up. FIG. 3A illustrates the uphole end of the safety valve system 200 showing the control mechanism of the safety valve system 200 and FIG. 3B illustrates the downhole end of the safety valve system, coupled with a tubing line 215. As shown in FIG. 3B, at a downhole end, rod 248 engages a poppet 250 beyond a valve seat 272 the downhole end of the TRSV 210 and spring 270 is compressed. The spring 270 shown in this example is included to provide a fail-safe closure if there is no pressure. This spring 270 is not needed to overcome a high amount of hydrostatic pressure in the control line 254, as in previous or traditional secondary safety valves. The downhole end of the secondary safety valve 240 may comprise a flow port 274 having a plurality of openings 276 or windows to allow for increased fluid flow through the valve system 200. FIG. 3A illustrates hydraulic connections 215A and 215B which may connect the control line 214 and balance line 212 of the TRSV 210 with the surface.

Figure 4A:
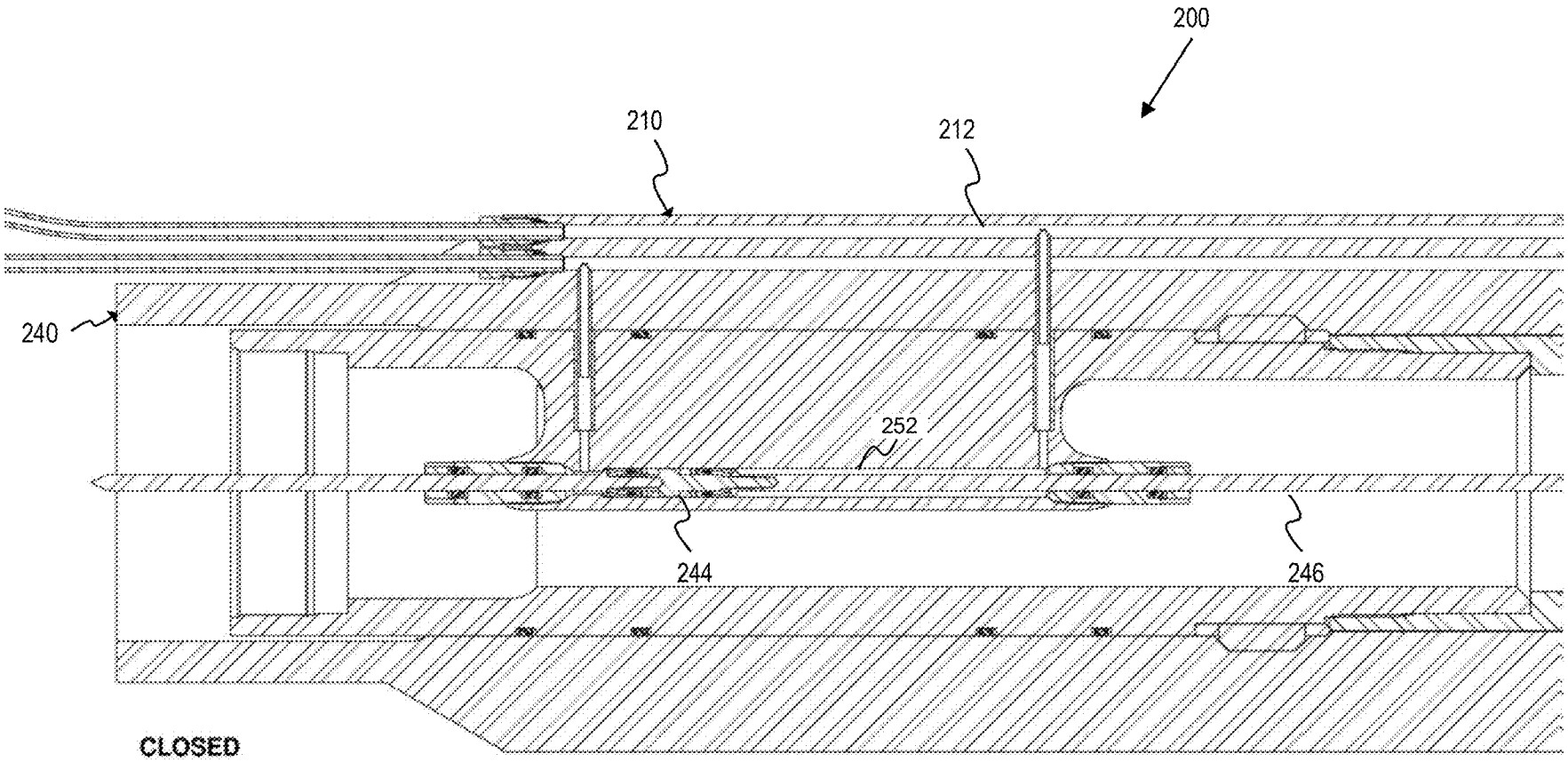
FIG. 4A is a side section view of the safety valve of the uphole end of the safety valve assembly of FIG. 2 shown in a closed position, according to some embodiments.
Figure 4B:
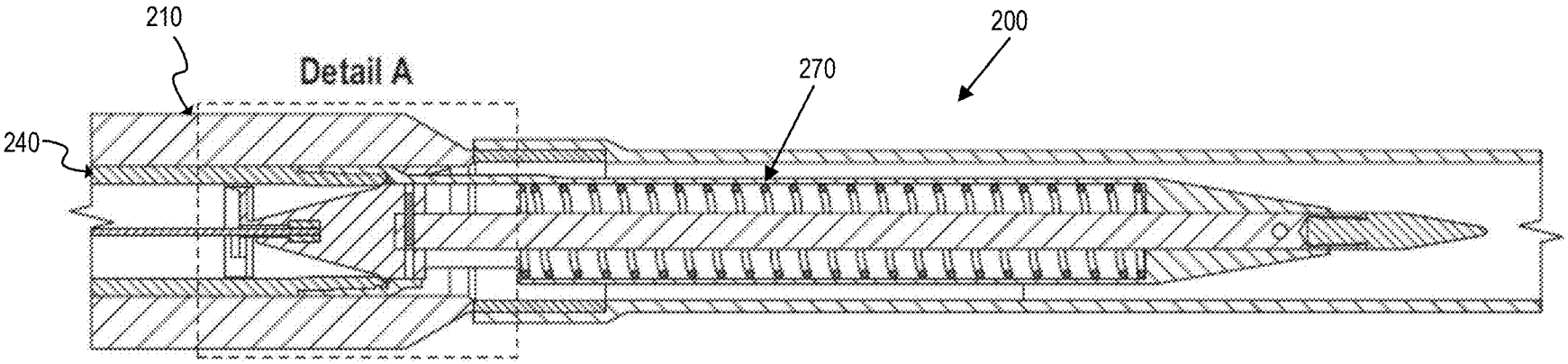
FIG. 4B is a side section view of a downhole end of the safety valve assembly of FIG. 2 shown in a closed position, according to some embodiments.
Figure 4C:
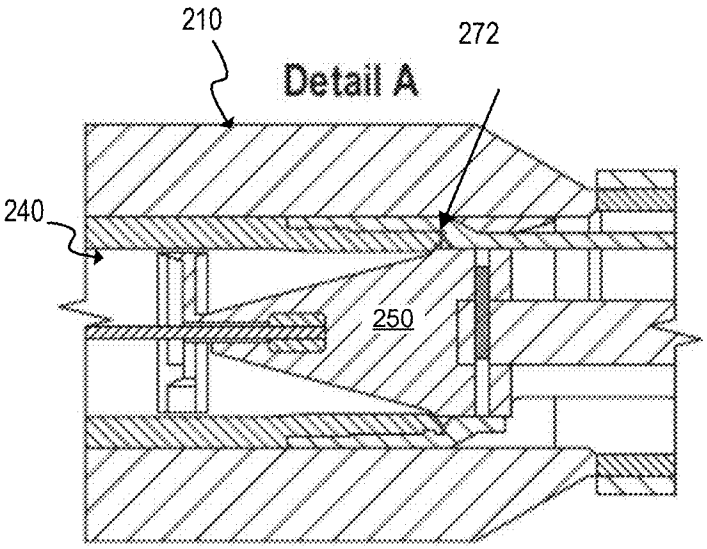
FIG. 4C is detailed view of Detail A shown in FIG. 3B, according to some embodiments.

Referring now to FIG. 4A-4C, there are shown side section views of the safety valve system 200 shown in a closed position. FIG. 4A illustrates the uphole end of the secondary safety valve 240 where the secondary safety valve 240 is hydraulically connected with the TRSV 210. The balance line 252 may have pressure, but the control line 254 has no pressure enabling the piston 244 to be seated in an uphole/closed position. FIGS. 4B and 4C are downhole ends of the secondary safety valve 240, with Detail A in FIG. 4C showing the connection between the rod 248 and poppet 250, which seals the downhole end of the secondary safety valve 240 when in a closed position. In this example, the poppet 250 engages a valve seat 272 of the secondary safety valve 240 to create a metal to metal seal, which is capable of withstanding the extreme conditions which may be present downhole. Other materials may be used to form the seal such as polytetrafluoroethylene (PTFE) or other polymers, non-elastomer materials, able to withstand the downhole conditions.

Although the safety valve system 200 shown in FIG. 3A-4C are shown having a spring, embodiments of the safety valve do not require a long spring to compensate for hydrostatic pressure since the secondary safety valve 240 is in control of both the control line and the balance line.

Example Operations

Figure 5:
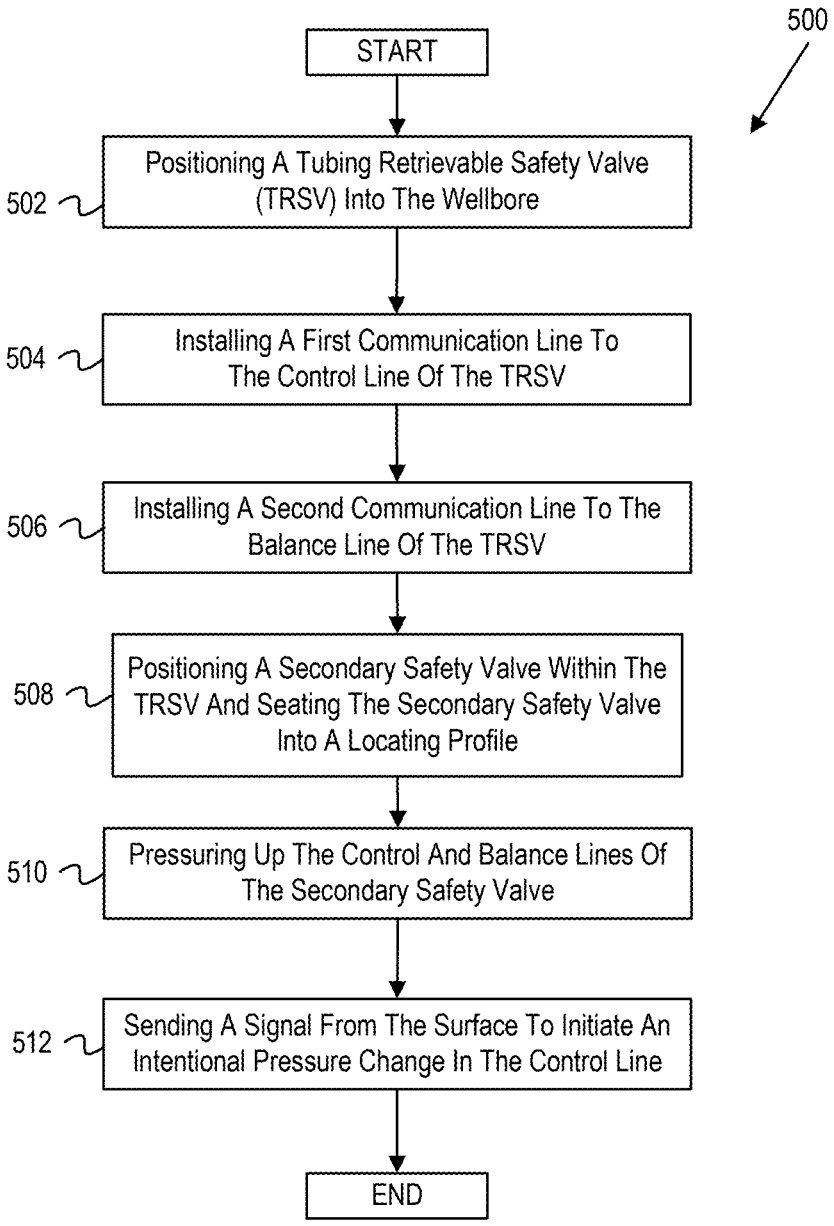
FIG. 5 is a flowchart illustrating a method, according to some embodiments.

Referring now to FIG. 5, there is shown one embodiment of a method 500 for controlling flow within a wellbore. The method begins at a block 502, positioning a TRSV into a wellbore, such as, e.g. wellbore 116 shown in FIG. 1. The TRSV includes at least an open bore therethrough, a control line, and a balance line.

The method continues at a block 504, installing a first communication port to the control line in the TRSV.

At a block 506, the method continues, installing a second communication to the balance line in the TRSV.

If the installed TRSV fails, the method continues at a block 508, positioning a secondary safety valve within the open bore of the TRSV. The secondary valve is seated into a locating profile in an inner diameter of the TRSV.

At a block 510, the first and second communication ports of the secondary safety valves are connected with the control and balance lines of the TRSV. Then the control and balance lines of the secondary safety valve may be pressured up such that the secondary safety valve is ready for use.

To change the secondary safety valve from an open position to a closed position, the method continues at a block 512, initiating an intentional pressure change in the control line. The intentional pressure change may be initiated by a signal from the surface, such as from control system 130, an operator, or a remote control system/operator. The intentional pressure change may be to release the control line pressure to close the secondary safety valve, or if there is no pressure, the control line of the secondary safety line will lose pressure and close. If there is no pressure in the TRSV control line, the power spring will keep the piston in the up end which is the valve in the closed position. If the TRSV loses control line pressure, the secondary safety valve control line pressure will go down as well, closing the secondary safety valve from an open position to a closed position.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

Aspects disclosed herein include:

Aspect A: A tubing insensitive safety valve for use in a tubing retrievable safety valve (TRSV) disposed downhole in a wellbore, the safety valve comprising at least: a valve body having a valve seat at a downhole end thereof; a piston; a rod coupled with a downhole end of the piston; a control line; a first pressure communication port, communicatively coupling the control line of safety valve with a TRSV control line; a balance line; and a second pressure communication port, communicatively coupling the balance line of the safety valve with a TRSV balance line; wherein the control line is configured to actuate the safety valve between an open position and a closed position in response to an intentional pressure change in the control line.

Aspect B: A valve system for use downhole in a wellbore, comprising: a tubing retrievable safety valve (TRSV) disposed downhole in the wellbore, the TRSV including at least a TRSV balance line and a TRSV control line; a secondary safety valve to be positioned within the TRSV, the secondary safety valve comprising: a valve body having a valve seat at a downhole end; a piston; a rod coupled with a downhole end of the piston; a control line; a first pressure communication port, communicatively coupling the control line of safety valve with the TRSV control line; a balance line; and a second pressure communication port, communicatively coupling the balance line of the safety valve with the TRSV balance line; wherein the control line is configured to actuate the safety valve between an open position and a closed position in response to an intentional pressure change in the control line.

Aspect C: A method for controlling fluid flow downhole in a wellbore, comprising at least: positioning a tubing retrievable safety valve (TRSV) disposed downhole in the wellbore, the TRSV including at least: an open bore therethrough; a balance line; and a control line; installing a first communication port to the control line of the TRSV into the TRSV; installing a second communication port to the balance line of the TRSV into the TRSV; positioning a secondary safety valve into the open bore within the TRSV and positioning the secondary safety valve into a locating profile in an inner diameter of the TRSV. The secondary safety valve comprises at least: a valve body having a valve seat at a downhole end; a piston; a rod coupled with a downhole end of the piston; a control line; a first pressure communication port, communicatively coupling the control line of safety valve with the control line of the TRSV; a balance line; and a second pressure communication port, communicatively coupling the balance line of the safety valve with the balance line of the TRSV; wherein the control line is configured to actuate the secondary safety valve between an open position and a closed position in response to an intentional pressure change in the control line.

Aspects A, B, and C may have one or more of the following additional elements in combination:

Element 1: wherein the safety valve is a wireline retrievable safety valve (WLRSV).

Element 2: wherein the intentional pressure change is initiated by a signal communicated from the surface of the wellbore to release the pressure in the control line.

Element 3: further comprising a first seal housing positioned downhole of the first pressure communication port and a second seal housing positioned uphole of the second pressure communication port.

Element 4: wherein the valve body is a flow housing having a plurality of openings in an outer diameter of the valve body near a downhole end thereof uphole end of the piston.

Element 5: wherein a shear plug is used for the first pressure communication port and for the second pressure communication port to communicate pressure from the control line and balance line of the safety valve with the TRSV control line and the TRSV balance line.

Element 6: wherein a communication tool is used for the first pressure communication port and for the second pressure communication port to communicate pressure from the control line and balance line of the safety valve with the TRSV control line and the TRSV balance line.

Element 7: the safety valve further comprising a poppet connected at a downhole end of the rod, the poppet configured to engage the valve seat in a closed position.

Element 8: comprising a metal to metal seal between the poppet and the valve seat.

Element 9: wherein the secondary safety valve is a wireline retrievable safety valve (WLRSV).

Element 10: wherein the secondary safety valve further comprises a first seal housing positioned downhole of the first pressure communication port and a second seal housing positioned uphole of the second pressure communication port.

Element 11: wherein the secondary safety valve does not include a flapper.

Element 12: wherein one of a shear plug or a communication tool is used for the first pressure communication port and for the second pressure communication port to communicate pressure from the control line and balance line of the secondary safety valve with the TRSV control line and the TRSV balance line.

Element 13: further comprising connecting the first and second pressure communication ports with the hydraulic control and balance lines of the TRSV and pressuring up the control line and the balance line of the secondary safety valve.

Element 14: further comprising sending a signal from the surface of the wellbore to initiate the intentional pressure change to release the control line and close the secondary safety valve.

Element 15: wherein one of a shear plug (after shearing) or a communication tool is used for the first pressure communication port and for the second pressure communication port to communicate pressure from the control line and balance line of the safety valve with the control line and the balance line of the TRSV, wherein the control line and balance line of the TRSV are hydraulic lines.

The invention claimed is:

1. A safety valve for use in a tubing retrievable safety valve (TRSV) disposed downhole in a wellbore, the safety valve comprising:

a valve body having a valve seat at a downhole end thereof, a piston; a rod coupled with a downhole end of the piston and with a closure mechanism configured to engage the valve seat when the safety valve is in a closed position;

a control line;

a balance line;

a first pressure communication port, to communicatively couple the control balance line of the safety valve with a TRSV balance line; and a second pressure communication port, to communicatively couple the control line of the safety valve with a TRSV control line, wherein, the control line of the safety valve is directly coupled to the TRSV control line by a first seal and the balance line of the safety valve is directly coupled with the TRSV balance line by a second seal, and the control line of the safety valve is configured to actuate the safety valve between an open position and the closed position in response to an intentional pressure change in the TRSV control line, and the balance line of the safety valve is configured to use hydrostatic pressure through the balance line to compensate for hydrostatic pressure acting on the TRSV control line, with the first seal and the second seal enabling equal pressure throughout the safety valve so there is no pressure differential across the safety valve.

2. The safety valve according to claim 1, wherein the safety valve is a wireline retrievable safety valve (WLRSV).

3. The safety valve according to claim 1, wherein the intentional pressure change is initiated by a signal communicated from the surface of the wellbore to release pressure in the control line of the safety valve.

4. The safety valve according to claim 1, further comprising a first seal housing to house the first seal and positioned downhole of the first pressure communication port, and a second seal housing to house the second seal and positioned uphole of the second pressure communication port.

5. The safety valve according to claim 1, wherein the valve body is a flow housing having a plurality of openings a portion of the valve body to enable increased flow production.

6. The safety valve according to claim 1, wherein a first shear plug, after shearing, is used to communicate pressure from the control line of the safety valve to the TRSV control line, and wherein a second shear plug, after shearing, is used to communicate pressure from the balance line of the safety valve to the TRSV balance line.

7. The safety valve according to claim 1, wherein a first communication tool is used to communicate pressure from the control line of the safety valve to the TRSV control line, and wherein a second communication tool is used to communicate pressure from the balance line of the safety valve to the TRSV balance line.

8. The safety valve according to claim 1, further comprising the closure mechanism as a poppet connected at a downhole end of the rod, the poppet configured to engage the valve seat in a closed position.

9. The safety valve according to claim 8, comprising a metal to metal seal between the poppet and the valve seat.

10. A valve system for use downhole in a wellbore, comprising: a tubing retrievable safety valve (TRSV) disposed downhole in the wellbore, the TRSV including at least a TRSV balance line and a TRSV control line; and a secondary safety valve to be positioned within the TRSV, the secondary safety valve comprising: a valve body having a valve seat at a downhole end; a piston; a rod coupled with a downhole end of the piston and with a closure mechanism configured to engage the valve seat when the secondary safety valve is in a closed position;

a control line;

a balance line;

a first pressure communication port, to communicatively couple the balance line of the secondary safety valve with the TRSV balance line; and a second pressure communication port, to communicatively couple the control line of the secondary safety valve with the TRSV control line, wherein, the control line of the secondary safety valve is directly coupled to the TRSV control line by a first seal and the balance line of the secondary safety valve is directly coupled with the TRSV balance line by a second seal, and the control line of the secondary safety valve is configured to actuate the secondary safety valve between an open position and the closed position in response to an intentional pressure change in the TRSV control line, and the balance line of the secondary safety valve is configured to use hydrostatic pressure through the balance line to compensate for hydrostatic pressure acting on the TRSV control line, with the first seal and the second seal enabling equal pressure throughout the secondary safety valve so there is no pressure differential across the secondary safety valve.

11. The valve system according to claim 10, wherein the secondary safety valve is a wireline retrievable safety valve (WLRSV).

12. The valve system according to claim 10, wherein the intentional pressure change is initiated by a signal communicated from the surface to release pressure in the control line of the TRSV.

13. The valve system according to claim 10, wherein the secondary safety valve further comprises a first seal housing to house the first seal and positioned downhole of the first pressure communication port, and a second seal housing to house the second seal and positioned uphole of the second pressure communication port.

14. The valve system according to claim 10, wherein the secondary safety valve does not include a flapper.

15. The valve system according to claim 10, wherein one of a shear plug, after shearing, or a communication tool is used to communicate pressure from the control line and balance line of the secondary safety valve to the TRSV control line and the TRSV balance line, respectively.

16. A method for controlling fluid flow downhole in a wellbore, comprising:

positioning a tubing retrievable safety valve (TRSV) disposed downhole in the wellbore, the TRSV including at least: an open bore therethrough; a balance line of the TRSV; and a control line of the TRSV;

installing a control communication port to the control line of the TRSV into the TRSV;

installing a balance communication port to the balance line of the TRSV into the TRSV;

positioning a secondary safety valve into the open bore within the TRSV and positioning the secondary safety valve into a locating profile in an inner diameter of the TRSV, the secondary safety valve comprising:

a valve body having a valve seat at a downhole end;

a piston;

a rod coupled with a downhole end of the piston and with a closure mechanism configured to engage the valve seat when the safety valve is in a closed position;

a control line of the secondary safety valve;

a balance line of the secondary safety valve;

a first pressure communication port, to communicatively couple the balance line of the secondary safety valve to the balance line of the TRSV; and a second pressure communication port, to communicatively couple the control line of the secondary safety valve to the control line of the TRSV, wherein, the control line of the secondary safety valve is directly coupled to the TRSV control line by a first seal and the balance line of the secondary safety valve is directly coupled with the TRSV balance line by a second seal, and the control line of the secondary safety valve is configured to actuate the secondary safety valve between an open position and the closed position in response to an intentional pressure change in the TRSV control line, and the balance line of the secondary safety valve is configured to use hydrostatic pressure through the balance line to compensate for hydrostatic pressure acting on the TRSV control line, with the first seal and the second seal enabling equal pressure throughout the secondary safety valve so there is no pressure differential across the secondary safety valve.

17. The method according to claim 16, further comprising connecting the first and second pressure communication ports with the control and balance lines of the TRSV, respectively, and pressuring up the control line and the balance line of the secondary safety valve to maintain hydrostatic equilibrium between control line pressure and balance line pressure.

18. The method according to claim 16, further comprising sending a signal from the surface of the wellbore to initiate the intentional pressure change to release the control line of the TRSV and close the secondary safety valve.

19. The method according to claim 16, wherein the secondary safety valve is a wireline retrievable safety valve (WLRSV).

20. The method according to claim 16, wherein one of a shear plug, after shearing, or a communication tool is used to communicate pressure from the control line and balance line of the secondary safety valve to the control line and the balance line of the TRSV, respectively.

* * * * *